United States Patent [19]

Zaccaro

[11] 3,986,639

[45] Oct. 19, 1976

[54] DISPENSING CLOSURE FOR COLLAPSIBLE TUBES

[76] Inventor: Linda Gail Zaccaro, 491 Merrick Road, Oceanside, N.Y. 11572

[22] Filed: Jan. 5, 1976

[21] Appl. No.: 646,534

[52] U.S. Cl. ..... 222/23; 46/135 R

[51] Int. Cl.[2] ..... B67D 5/08; A63H 11/00

[58] Field of Search ..... 222/23; 46/116, 135 R, 46/106.51; 40/28.6, 106.32

[56] References Cited

UNITED STATES PATENTS

| | | | |
|---|---|---|---|
| 1,419,136 | 6/1922 | Hauck | 46/135 R |
| 2,628,742 | 2/1953 | Kierulff | 222/23 |

*Primary Examiner*—Allen N. Knowles
*Assistant Examiner*—Hadd Lane
*Attorney, Agent, or Firm*—Bauer, Amer & King

[57] ABSTRACT

A closure is provided for a collapsible tube having a cap portion which engages a movable slide member. When the cap is open, the slide member is moved. Indicia is visible through openings in the closure member, creating the image of animation. The closure is in the form of a fanciful figure, such as a head. When toothpaste is dispensed, it emerges from an opening in the head or design in a shape as determined by the opening outline, thus extruding the toothpaste in an appealing form.

5 Claims, 7 Drawing Figures

DISPENSING CLOSURE FOR COLLAPSIBLE TUBES

This invention relates to dispensing and, more particularly, to a dispensing closure for collapsible tubes.

BACKGROUND OF THE INVENTION

Young children have difficulty in screwing back threaded tooth caps onto collapsible tubes. There exists, therefore, a need for a permanently attachable dispensing closure for collapsible tubes, which may be operated by small children. There is also a need to provide an attractive, animated dispensing closure and appealing shape to the toothpaste, which will encourage children to use the tube as, for example, when it is used for dispensing toothpaste. It is essential that such devices be inexpensive and convenient to use.

SUMMARY OF THE INVENTION

A dispensing closure is provided for collapsible tubes which may be permanently screwed onto the thread of the tube and which has a simple cover, which may be operated by young children. As the cover is lifted, a moving member causes the movement of eye and mouth members to simulate animation.

It is, therefore, an object of this invention to provide a dispensing closure for collapsible tubes which may be utilized for dispensing pastes and which may be conveniently cleaned and sterilized when necessary.

It is a further object of the invention to provide a dispensing closure for collapsible tubes which will simulate animation when the cover is opened to permit paste to be dispensed therefrom in an appealing design.

Another object of the invention is the provision of a dispensing closure for collapsible tubes which closure simulates a fanciful animated head and is provided with a valve for closing a dispensing aperture, portions of the valve constituting significant parts of the fanciful head.

A still further object of the invention is the provision of a dispensing closure for collapsible tubes simulating a fanciful animated head, such closure being provided with a valve for closing a dispensing aperture, portions of the valve constituting significant parts of the head, and the closure further being of such configuration as to immediately appeal to children.

Another object is to create designs as the tube is squeezed, either a flower or multiple openings and those such as will appeal to the young people.

Still other objects and advantages of the invention will, in part, be pointed out with particularity and will, in part, become obvious from the following more detailed description of the invention, taken in conjunction with the accompanying drawing which forms an integral part thereof.

In the various figures of the drawing, like reference characters designate like parts.

IN THE DRAWING

DESCRIPTION OF THE PREFERRED EMBODIMENT

Figure 1:
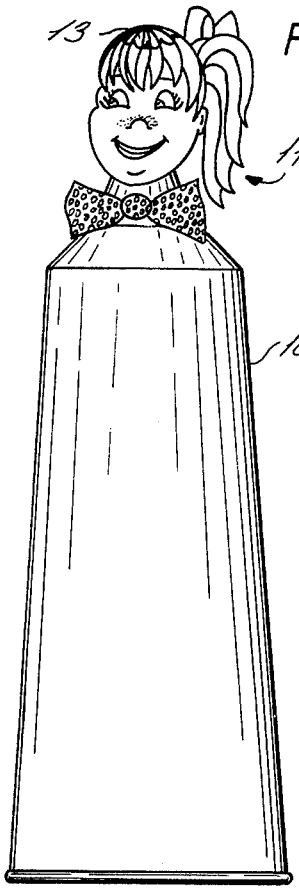
FIG. 1 is an elevational view of the collapsible tube with the dispensing closure of this invention secured thereto.
Figure 2:
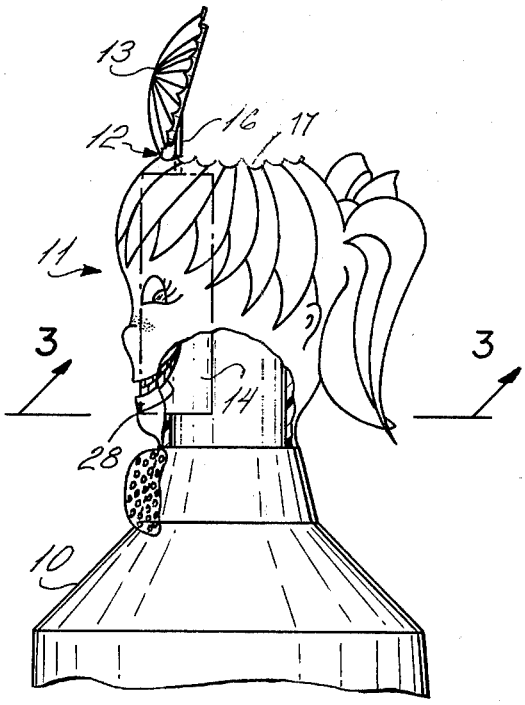
FIG. 2 is a side elevational view of the apparatus shown in FIG. 1, with a portion cut away, and the cap member in an open position.
Figure 7:
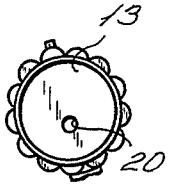
FIG. 7 is a plan view of the cap member as viewed on the inside.
Figure 6:
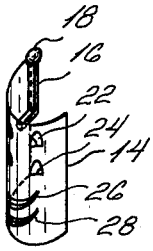
FIG. 6 is a perspective showing of the movable insert.
Figure 3:
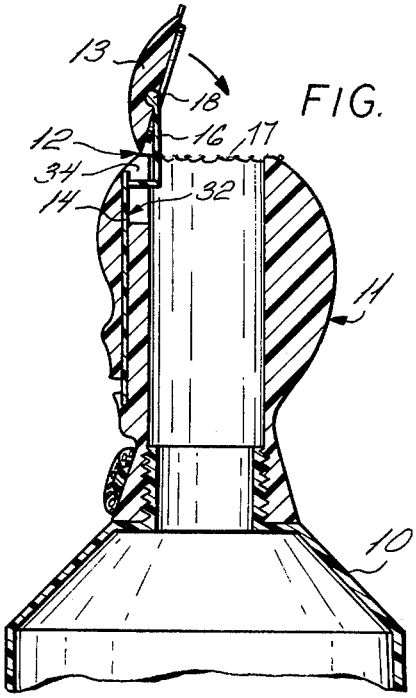
FIG. 3 is a section taken along line 3—3 of FIG. 2.

Referring now to FIG. 1 of the drawing there is shown a collapsible tube 10 and the cap of this invention affixed thereto, indicated generally by the reference numeral 11. It is envisioned that the closure be molded from a plastic, such as polypropylene, which would permit the cover to be self-hinged in accordance with current molding practice. Hinge 12 may, of course, be of any other conventional type. A movable insert 14, shown more fully in FIG. 6, is connected to the cap by means of arm 16 which has a ball 18 adapted to be secured in socket 20. As the cap 13 is raised, arm 16 is caused to move upwardly, drawing with it slide member 14. The slide member 14 may be provided with two sets of eyes 22 and 24 and mouth portions 26 and 28. It will be noted that closed lips 27 show in mouth outline 26 while in mouth outline 28 teeth 29 are visible as eyes appear to move from side to side. The movement of the eyes and mouth are examples of animation. The cheeks, for example, can be made to change from white to a rosy red, etc.

Figure 4:
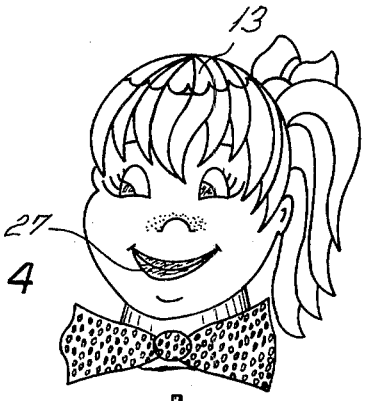
FIG. 4 is a front elevational view of the dispensing closure with the cover in a closed position.
Figure 5:
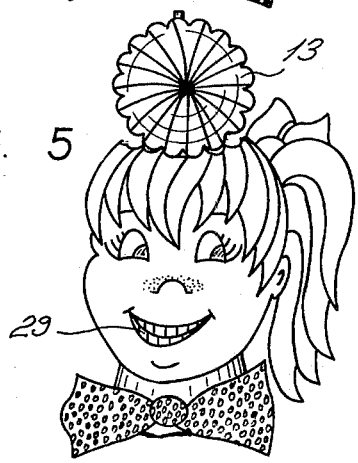
FIG. 5 is a view similar to FIG. 4 with the cap in an open position.

Referring now to FIG. 4, it will be noted that, with the cap down, the eyes are turned to the left and merely lips 27 appear, while in the raised position, shown in FIG. 5, the eyes have rolled to the right and the mouth exhibits a set of teeth 29 arranged for brushing. This serves to suggest to the child that he should brush his teeth.

In FIG. 6 there is shown the slide member 14. It is contemplated that this member be molded of a rigid plastic, such as polystyrene, and have a thickness in the order of 0.010 inches. Arm member 16 may be integrally molded or might be otherwise fashioned. For example, member 14 may be stamped out of flat bendable sheet material having imprinted thereon, by silk screening or other printing process, the desired indicia and member 16 be separately formed and affixed thereto. If member 16 is formed of plastic, it may be solvent or heat sealed to member 14. The particular method of manufacture is well within the state of the art and does not form part of my invention.

The slide member 14 is slipped into a recess 32 molded into the figure. The member 16, passing through a slit 34, which may be then sealed by any of the conventional sealing means, such as an adhesive, solvent or by the application or sufficient heat to fuse the material. The sealing operation will captivate member 14 and also prevent any material from inside the tube being dispensed through the opening.

Preferably, the opening 17 is scalloped, or non-circular, to provide an attractive flower like strip of paste which has been found to intrigue young persons.

Thus, there has been disclosed an attractive dispensing device for collapsible tubes, which encourages the dispensing of paste therefrom.

What is claimed is:

1. A closure for a collapsible container having a threaded neck for dispensing the contents of the container therethrough, said closure comprising a hollow plastic plug with an internal bore terminating at one end in an internal thread adapted to mate with the threaded neck of the collapsible container, a hinged cap member arranged to cover the other end of the bore for sealing material within the bore, the closure member being in the form of a fanciful figure, having at least one window opening; a moveable member coupled to the cover member and carrying at least two sets of indicia, only one of said sets being visible in a selected one of a cover open and cover closed position through the window.

2. The closure of claim 1 in the form of a face having a pair of eye openings and a mouth opening, said moveable member being a slidable member linked to said cover member whereby when said cover member is moved, said slidable member moves in response thereto, the slidable member having two pairs of eyes, each of said pair of eyes arranged to mate with the eye openings in the closure member in each of a set of open and closed positions whereby, in the open position of the cap, a set of teeth appear behind the mouth opening in the closure member and, in the closed position, the teeth do not appear in the mouth opening.

3. The closure of claim 1 wherein the said movable member is coupled to the cover member by a ball and socket joint means.

4. The closure of claim 1 wherein the said other end of the bore terminates in non-round opening.

5. The closure of claim 4 wherein the opening is in the shape of a flower.

* * * * *